US006935396B2

(12) United States Patent
Sacksteder et al.

(10) Patent No.: US 6,935,396 B2
(45) Date of Patent: Aug. 30, 2005

(54) SPLICING TAPE APPLICATION DEVICE WITH RIGID ELECTROSTATIC CHARGE ELIMINATOR

(75) Inventors: Michel Sacksteder, Chatenoy le Royal (FR); Philippe Martin, Chatenoy en Bresse (FR)

(73) Assignee: Eastman Kodak Company, Rochester, NY (US)

( * ) Notice: Subject to any disclaimer, the term of this patent is extended or adjusted under 35 U.S.C. 154(b) by 10 days.

(21) Appl. No.: 10/484,825

(22) PCT Filed: Jul. 6, 2002

(86) PCT No.: PCT/EP02/07549

§ 371 (c)(1),
(2), (4) Date: Jan. 22, 2004

(87) PCT Pub. No.: WO03/010077

PCT Pub. Date: Feb. 6, 2003

(65) Prior Publication Data

US 2005/0000659 A1 Jan. 6, 2005

(30) Foreign Application Priority Data

Jul. 25, 2001 (FR) ..... 01 09885

(51) Int. Cl.[7] ..... B32B 31/00; B65H 81/00

(52) U.S. Cl. ..... 156/447; 156/187; 156/157; 242/555.3; 242/556.1

(58) Field of Search ..... 156/157, 159, 156/187, 256, 447, 517; 242/551, 553, 555.4, 556.1; 428/41.7, 57, 41.8, 343

(56) References Cited

U.S. PATENT DOCUMENTS 5,902,448 A 5/1999 Stettner

FOREIGN PATENT DOCUMENTS

| | | | |
|---|---|---|---|
| DE | 28 07 025 A | | 8/1979 |
| EP | 0 044 814 A | | 1/1982 |
| EP | 0 487 107 A1 | | 5/1992 |
| EP | 0 708 580 | | 4/1996 |
| EP | 1 059 157 A | | 12/2000 |
| WO | WO 97/14126 | * | 4/1997 |

* cited by examiner

*Primary Examiner*—Mark A. Osele
(74) *Attorney, Agent, or Firm*—David A. Novais

(57) ABSTRACT

The invention is in the field of devices enabling the sticking of splicing tapes to the ends of strips put into rolls, to prevent their later unwinding. The present invention relates to a device (1) for applying splicing tapes (22) on a strip (30) made of flexible material. The device (1) is equipped with a passive device (50) enabling the elimination of the electrostatic forces that disturb the operation of the device. The device (1) according to the invention is mainly used on photographic film or paper slitters.

7 Claims, 2 Drawing Sheets

SPLICING TAPE APPLICATION DEVICE WITH RIGID ELECTROSTATIC CHARGE ELIMINATOR

FIELD OF THE INVENTION

The present invention is in the field of devices that enable the sticking of splicing tapes onto other strips usually made of flexible material. These devices must operate correctly, and especially not cause sticking faults due to electrostatic phenomena. More specifically, the invention is in the field of automatic devices for sticking splicing tape onto the strands of the ends of strips forming rolls or reels of photographic films or papers; with the sticking process intended to prevent the strips from unwinding, just after they have been cut on a slitter.

BACKGROUND OF THE INVENTION

The use of slitters is universally known in the photographic industry. Slitters enable the simultaneous cutting into several strips with preset widths of a wider strip or axis of film or paper previously coated with a photosensitive emulsion layer. The wider strip to be cut has a programmed length itself. The cut strips obtained from the wider strip are wound around a central core. Each of the rolls thus obtained ends with a free strand. The free strand is intended to take a pre-glued splicing tape of flexible material, to fix this free strand of the strip end onto its roll, in order to prevent the roll from unwinding during later manipulations or operations in the process, in particular during the operation of packaging the rolls and transport of the rolls. The splicing tape is applied to the roll using an automatic sticking device, attached to an annexed part of the slitter. This sticking device automatically places and sticks the splicing tapes onto the free strands of the respective rolls. Before the sticking operation of the splicing tapes to the roll, they are previously unstuck or separated from a support strip. The unsticking generates electrostatic forces that cause quality faults, because the separated splicing tape is deviated from its planned path towards the free strand of the strip end to be stuck. Therefore, it does not stick the free strand onto its roll. In addition the deviated splicing tape is often found, for example, inside the sticking device and disturbs its operation It is an object of the present invention to eliminate the effect of electrostatic forces in sticking devices used on slitters.

The principle enabling electrostatic forces to be eliminated is well known to those skilled in the art. It includes using ionization of the air. To eliminate electrostatic forces, passive induction means, comprising points linked to ground for example are used, as described in Patent EP 708,580.

SUMMARY OF THE INVENTION

The present invention relates to a splicing tape sticking or application device equipped with a passive means that enables the elimination of the electrostatic forces that disturb the operation of the device as far as stopping the operation. Stopping the operation of the sticking device causes the slitter to stop; these stops generate significant productivity losses that the device according to the invention eliminates.

The present invention relates to a device for applying precut splicing tapes initially attached successively to a first strip serving as support made of flexible material, onto a second strip made of flexible material of the roll end, by successively separating the splicing tapes of the first strip. The device comprises a frame in which are arranged the means for unwinding, winding, guiding, and mechanical tension check of the first strip, and a pressure part that enables the splicing tape separated from the first strip to be applied to the second strip of the roll end when the roll is approached by the pressure part. The device is characterized in that it further comprises a passive means of electrostatic discharge acting by the electrical field effect and attached to one of the device's guiding means. The passive means has its end placed in the sticking zone just before the intersection of the paths of the separated slicing tape and the second strip to be stuck, as close as possible to the path of the separated slicing tape without touching the tape, and without touching the second strip to be stuck, so as to generate the electrostatic discharge of the zone and prevent attraction of the separated tape by the pressure means.

Other advantages and characteristics of the present invention will appear in the following description and more particularly in a preferred embodiment of the invention illustrated in the following figures.

DETAILED DESCRIPTION OF THE INVENTION

The following detailed description refers to a preferred embodiment of the invention; this with reference to the drawings of the above figures, wherein the same reference numbers identify the same parts for each of the various figures.

Figure 1:
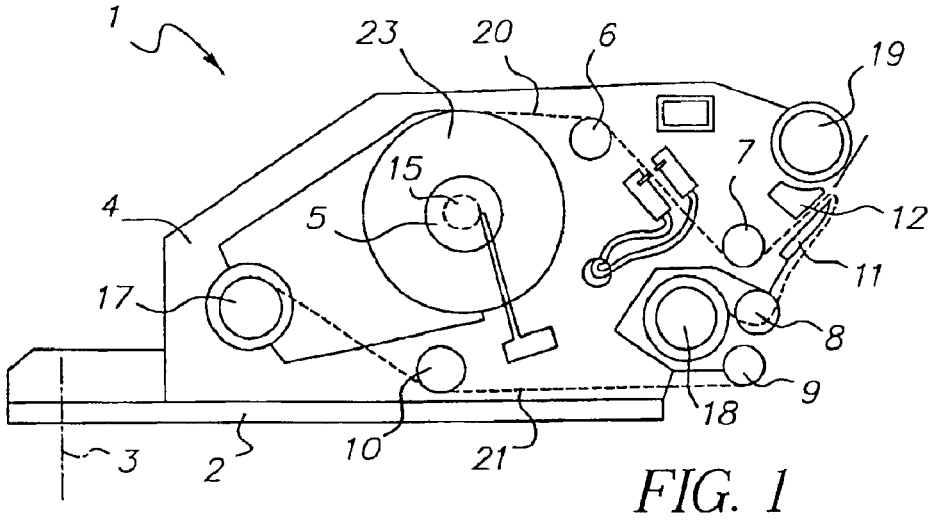
FIG. 1 represents a diagram of the device according to the invention.
Figure 4:
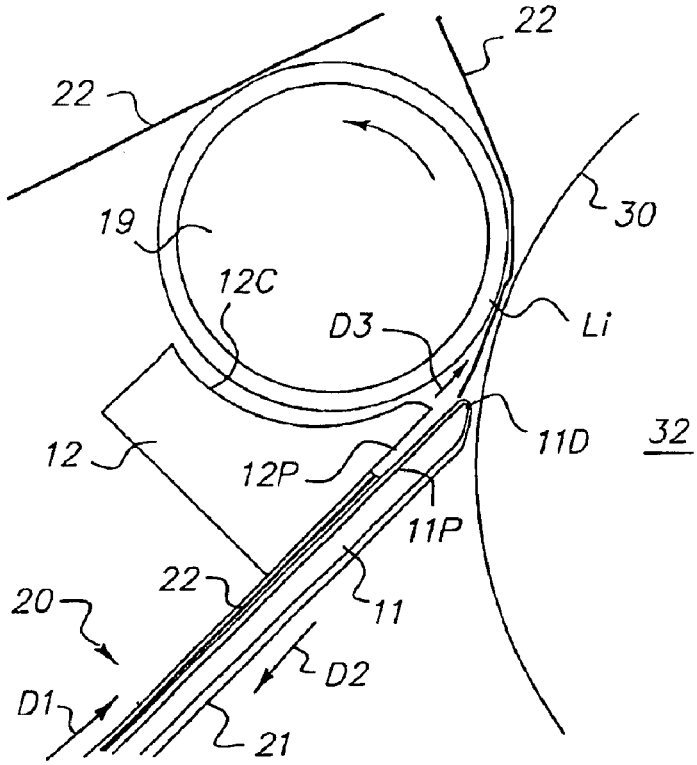
FIG. 4 represents the operation of a device which does not comprise the means according to the invention.
Figure 5:
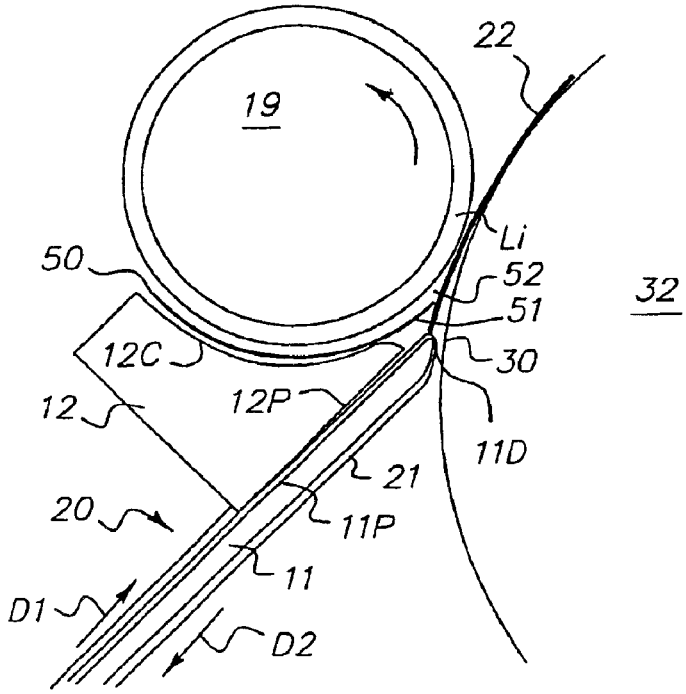
FIG. 5 represents the operation of the device according to the invention.

FIG. 1 represents a diagram of the device 1 according to the invention. It is attached, for example, on a slitter for photographic film or paper using a slide 2 and a locking means 3. The slide 2 is, for example, dovetail shape and the locking means 3 is a device comprising a shaft and cam lever. The device 1 enables the application and sticking of splicing tapes 22 onto the free strand 30 of a roll 32 of strips of photographic film or paper having a preset width, so that the free strand 30 is fixed onto the roll 32 (FIGS. 4 and 5). The application of the splicing tapes 22 by the device 1 onto the roll 32 prevents the roll 32 from unwinding during later operations or handling. It is contemplated to attach to the slitter several devices 1 for applying splicing tapes according to the invention, i.e. one device per cut strip on the machine, which enables the simultaneous sticking of the free strands 30 of each of the corresponding rolls 32. The device 1 comprises a frame 4 in which are arranged various means that enable the storage and running of a strip 20. The means of the device 1 are respectively an unwinder means or device 5 of the strip 20, a guide or guiding means 6, 7, 8, 9, 10, 11, 12, 18, a mechanical tension checker or mechanical tension check means 15 of the strip 20, a winder or winding means or device 17 of the strip 20 and an applicator or means 19 that enables application and pressing of the splicing tape 22 separated from the strip 20 onto the free strand 30. According to a preferred embodiment of the invention, the unwinding 5 and winding 17 means are rotating metal cylinders.

The means 15 enables checking of the tension of the strip 20 during its unwinding from the cylinder 5. The means 15 is, for example, a preset mechanical device attached to the shaft of the cylinder 5; this device brakes the cylinder 5 during unwinding, so as to maintain an appropriate tension opposed to the unwinding of the strip 20. During operation of the device 1, this tension stays less than the winding tension of the cylinder 17. Guiding means 6, 7, 8, 9, 10, are rotating cylinders made of plastic, for example PVC; the means 18 and 19 are for example rotating metal cylinders not coated or coated with polyurethane or neoprene. The guiding means 11 and 12 are flat guiding parts attached to the frame 4; these guiding means 11 and 12 comprise adjacent plane surfaces 11P and 12P that enable holding of the strip 20 and separation of the splicing tape 22 from the strip 20 at 11D. According to a preferred embodiment, the flat guide 11 and the flat guide 12 are metal, in order to provide good electrical conduction. While in another embodiment, the flat guide 12 can be for example metalized Teflon.

Figure 2:
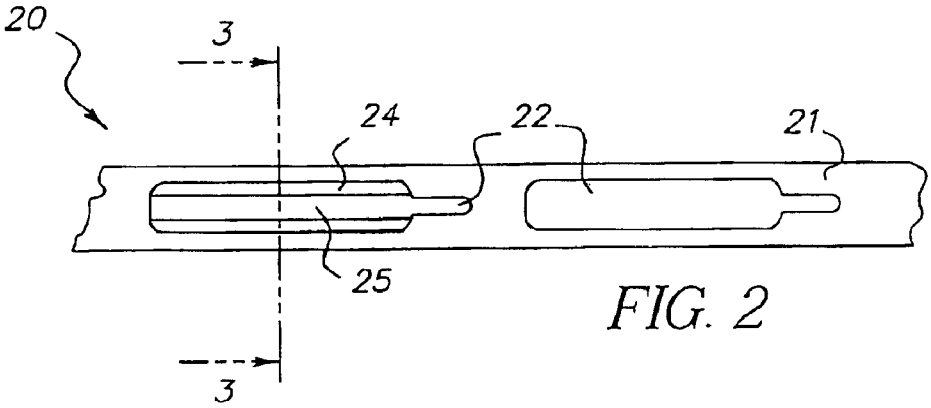
FIG. 2 represents a splicing tape and its support used in the device according to the invention.
Figure 3:
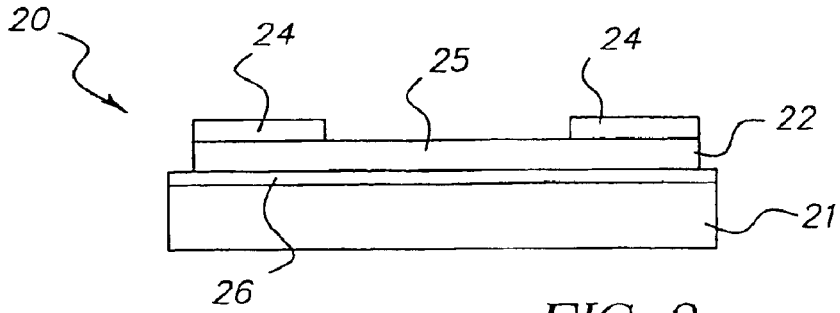
FIG. 3 represents cross-section 3—3 of FIG. 2.

The device 1 enables a roll 23 of strip 20 to be automatically unwound. FIG. 2 represents the strip 20 whose essential part is a support strip 21 coated with a fine layer of solid saturated hydrocarbons 26. On the support 21 splicing tapes 22 precut into pre-glued adhesive foils are placed one following the other. The layer of hydrocarbons 26 enables the tapes 22 to stick to the support strip 21. The splicing tape 22 comprises at least one pre-glued zone 24 and one zone without glue 25, as shown in FIGS. 2 and 3. The pre-glued zone 24 is on the side opposite the support 21. The strip 20 is for example a roll of wax paper 21 on which are arranged at regular intervals thin precut splicing tapes 22 made of plastic. The device 1 according to the invention unwinds from the roll 23, the strip 20 comprising the support strip 21 which is usually paper and on which are set the splicing tapes 22. As shown in FIGS. 4 and 5, the strip 20 comes to the outlet of the device 1 in the flat guides 11 and 12 zone following the path D1. When part of the strip 20 supporting the splicing tapes 22 comes to the break line 11D forming the end of the flat extended guide 11, the strip 22 is folded back to follow the path D2. At 11D, by the break generated by the shape of the flat guide 11, the splicing tape 22 is unstuck from its support 21 and by inertia follows the path D3, to go between the pressure cylinder 19 and the free strand 30 of the roll 32. The roll 32 has been placed close to the pressure cylinder 19 by a not shown means attached to the slitter. In the 11D zone, the unsticking of the splicing tape 22 from its support 21 generates significant electrostatic forces.

According to the splicing tapes 22 used, and in particular according to their surface area, the surface density of the corresponding charge is variable. For example, for splicing tapes with a surface area of 11 square centimeters (1.8 cm by 6.3 cm) intended to stick the free strand 30 of a roll of photographic paper 32, the surface density of the average charge is approximately 1.4 nanocoulomb per square centimeter. The electrostatic forces generated by the unsticking of the splicing tape 22 from its support 21 and the friction of the support 21 of the strip 20 on the flat guide 11 have the effect of attracting the splicing tape 22 to the rotating pressure cylinder 19 as shown in FIG. 4. Despite the glued zone 24 provided to stick the slicing tape 22 onto the roll 32 and the force exerted by the pressure cylinder 19, the resulting electrostatic force is large enough for the splicing tape not to stick to the roll 32, and stay attracted by the cylinder 19. The consequence of this phenomenon is on the one hand not sticking to the free strand 30 on the roll 32 and on the other hand accumulating the splicing tapes 22 on the cylinder 19. The secondary consequences are unwanted separations of the stuck tapes, for example, one with another and which are found everywhere in bunches in the device 1 or around it, or even accumulate and contaminate the roll 32. The electrostatic charge created when unsticking the splicing tape 22 generates a matching charge on the pressure cylinder 19. The charge on the cylinder 19, by the metal nature of the cylinder 19 and because the radius of curvature of the cylinder 19 is less than the radius of curvature of the roll 32, is greater than the charge of the same sign created on the roll 32. In addition, as the charge on the splicing tape 22 that is not electrically very conductive is of the opposite sign to that of the pressure cylinder 19, the tape 22 is attracted by the cylinder 19 which exerts an attraction force greater than that of the roll 32. The charge on the splicing tape 22 that is not electrically very conductive persists in time, i.e. the relaxation time enabling the tape 22 to fully discharge the electricity is about several tens of seconds after the unsticking. Whereas the application process of a splicing tape 22 using the device 1 only lasts a few seconds; thus the embodiment corresponding to FIG. 4 systematically generates the problems mentioned above.

The device according to the invention includes using a simple and robust means 50 in the device 1 to eliminate the interfering electrostatic forces generated by the unsticking of the splicing tape 22 at 11D. The means 50, used in the invention, is a "passive" means of electrostatic discharge in the sense that it does not include or use an energy source. The means 50 acts by electrical field effect and by its low radius of curvature; it enables charges matching those generated on the splicing tape 22 to concentrate at its end 51 placed in the sticking zone 52. The electrical field has sufficiently high intensity to reach a value greater than or equal to the ionization potential of the ambient air in the sticking zone 52. The air zone thus ionized is made electrically conductive. The sticking zone 52 is thus practically discharged and the resulting charge on the splicing tape 22 is no longer enough for the tape 22 to be attracted by the pressure cylinder 19.

According to a preferred embodiment of this invention, this means 50 is a very thin metal foil, attached to the concave top part 12C of the guide 12 with fixing means enabling the foil 50 of the guide 12 to not be electrically insulated. The thickness of the foil is between 0.05 mm and 0.10 mm. In a preferred embodiment of the invention the thickness of the foil is 0.06 mm. The guide 12 in combination with the extended flat guide 11 ensures the guiding of the strip 21 carrying the splicing tapes 22. For this purpose the guides 11 and 12 comprise adjacent plane surfaces 11P and 12P. The emerging length 51 of the foil 50 in relation to the guide 12 is situated in the ionized air zone 52, just before the line of intersection Li of the paths of the splicing tape 22 and the strip 30 of the roll 32. The emerging length 51 is adjusted to not make contact with the roll 32, while being situated as close as possible to the path D1, D3 of the splicing tape 22. Thus positioned, the foil 50 enables electrostatic discharge of the tape 22 separated or unstuck from its support 21, which prevents the separated tape 22 from being attracted by the rotating cylinder 19. In a preferred embodiment, the foil 50 is supported by the metal guide 12, to ensure electrical continuity of the assembly to ground through the frame 4 of the device 1. In the zone to be discharged the uniformity of electrostatic discharge using the foil 50 is better than using for example a point.

While the invention has been described in detail and with reference to a preferred embodiment it will be apparent that all changes and modifications of this preferred embodiment leading to other embodiments within the spirit and scope of the claims should be considered as equivalent and integrated in the present application.

What is claimed is:

1. A device for applying precut splicing tapes initially attached successively to a first strip serving as support made of flexible material, onto a second strip made of flexible material of an end of a roll, by successively separating the splicing tapes from the first strip, said device comprising:

at least one frame in which are arranged an unwinding device, a winding device, a guide, and a mechanical tension checker of the first strip, a pressure part enabling the splicing tape separated from the first strip to be applied to a second strip of the end of the roll when said roll is approached by the pressure part;

a passive device of electrostatic discharge acting by an electrical field effect and attached to one of the guides of the device, said passive device having an end placed in a sticking zone just before an intersection of paths of the separated splicing tape and the second strip to be stuck, as close as possible to the path of the separated splicing tape without touching said tape, and without touching the second strip to be stuck, so as to generate the electrostatic discharge at the sticking zone and prevent attraction of the separated tape by the pressure part.

2. A device according to claim 1, wherein the passive device of electrostatic discharge is an electrically conductive foil.

3. A device according to claim 2, wherein a thickness of the foil is between 0.05 mm and 0.10 mm.

4. A device according to claim 3, wherein a preferred thickness of the foil is 0.06 mm.

5. A device according to claim 1, wherein the first support strip made of flexible material, a paper strip, coated with a thin layer of solid saturated hydrocarbons.

6. A device according to claim 1, wherein the splicing tapes, pre-glued and fixed successively to the first support strip, comprise at least one pre-glued zone on the side opposite the support strip.

7. A device according to claim 1, wherein the second strip of flexible material is a photographic paper strip.

* * * * *